US010486218B2

(12) United States Patent
Plaut

(10) Patent No.: US 10,486,218 B2
(45) Date of Patent: Nov. 26, 2019

(54) CHAMBER FOR ELECTROHYDRAULIC FORMING

(71) Applicant: ADM28 S.ÀR.L, Luxembourg (LU)

(72) Inventor: Eran Plaut, Zofit (IL)

(73) Assignee: ADM28 S.ÀR.L, Luxembourg (LU)

( * ) Notice: Subject to any disclaimer, the term of this patent is extended or adjusted under 35 U.S.C. 154(b) by 0 days.

(21) Appl. No.: 15/538,644

(22) PCT Filed: Dec. 31, 2015

(86) PCT No.: PCT/EP2015/081468
§ 371 (c)(1),
(2) Date: Jun. 21, 2017

(87) PCT Pub. No.: WO2016/107927
PCT Pub. Date: Jul. 7, 2016

(65) Prior Publication Data

US 2018/0264537 A1 Sep. 20, 2018

(30) Foreign Application Priority Data

Dec. 31, 2014 (FR) ..... 14 63492

(51) Int. Cl.

| | |
|---|---|
| ***B21D 26/12*** | (2006.01) |
| ***B21D 26/06*** | (2006.01) |
| ***B21D 26/02*** | (2011.01) |
| ***B21D 26/021*** | (2011.01) |

(52) U.S. Cl.
CPC ..... *B21D 26/12* (2013.01); *B21D 26/02* (2013.01); *B21D 26/06* (2013.01); *B21D 26/021* (2013.01)

(58) Field of Classification Search
CPC ..... B21D 26/06; B21D 26/12; B21D 26/02; B21D 26/021; B21D 26/031; B21D 26/023
See application file for complete search history.

(56) References Cited

U.S. PATENT DOCUMENTS

| | | | | |
|---|---|---|---|---|
| 3,188,844 | A | 6/1965 | Schwinghamer | |
| 3,200,626 | A | 8/1965 | Meyers | |
| 6,227,023 | B1 * | 5/2001 | Daehn | B21D 26/06 72/57 |
| 6,591,649 | B1 | 7/2003 | Gafri et al. | |
| 7,493,787 | B2 | 2/2009 | Golovashchenko et al. | |
| 7,827,838 | B2 * | 11/2010 | Golovashchenko | B21D 26/12 72/56 |
| 2014/0053622 | A1 | 2/2014 | Bonnen et al. | |

* cited by examiner

*Primary Examiner* — Pradeep C Battula
(74) *Attorney, Agent, or Firm* — Im IP Law; C. Andrew Im; Chai Im

(57) ABSTRACT

An electrohydraulic forming chamber to form a workpiece. The chamber includes a discharge frame that has an inner wall which delimits a discharge space provided to hold a volume of fluid, a female mold having a forming space which includes an impression configured to be complementary to the shape of the workpiece after deformation, and an electrohydraulic discharge system. The workpiece is placed between the discharge space and the forming space before the electrohydraulic discharge system is activated. Upon activation of the electrohydraulic discharge system, the workpiece is catapulted against the impression in the forming space and is deformed accordingly. All or part of the inner wall is provided with a non-metal coating.

5 Claims, 2 Drawing Sheets

CHAMBER FOR ELECTROHYDRAULIC FORMING

RELATED APPLICATIONS

This application is a § 371 application from PCT/EP2015/081468 filed Dec. 31, 2015, which claims priority from French Patent Application No. 14 63492 filed Dec. 31, 2014, each of which is incorporated herein by reference in its entirety.

FIELD OF THE INVENTION

The present invention relates to the field of forming, and more particularly to the field of electrohydraulic forming. The present invention relates to an electrohydraulic forming chamber, notably for forming pieces of small dimensions.

BACKGROUND OF THE INVENTION

Hydraulic forming methods are generally used as manufacturing methods, notably for pieces of complex forms. They involve using the pressure of a fluid, preferably a liquid, to produce the plastic deformation of a steel plate held in a mold. The fluid then acts on the steel plate to make it follow the form of the mold. This fluid can be pressurized in various ways.

Among the existing hydraulic forming methods, the electrohydraulic forming method, called EHF method, can be cited. This method is a very high speed deformation forming method which is based on an electrical discharge of a high energy stored in capacitors either between two electrodes placed in a chamber filled with fluid, or in an explosive wire placed in a chamber filled with fluid. When an electrical discharge is created in the fluid, a shockwave is generated in said fluid, it is propagated and projects the steel plate against the mold. The dynamic pressure thus generated on the steel plate allows the high speed deformation of its constituent material which is projected against the mold, thus allowing the forming thereof.

Such a method makes it possible to form steel plates but also other pieces produced in a plastically deformable material. It is used to produce pieces of large dimensions, that is to say pieces whose characteristic length is significantly greater than a distance between the two electrodes.

Such a method offers numerous advantages, notably the obtention of very fine details on the pieces, such as, for example, etchings, the absence of elastic return, or even low manufacturing costs.

However, one of the drawbacks lies in the cycle time necessary for the forming of a piece, as indicated in the U.S. Pat. No. 7,493,787. In effect, as is known, a forming cycle via the EHF method breaks down into several steps:

- placement of the piece to be formed in an electrohydraulic forming chamber,
- filling a hollow chamber in the electrohydraulic forming chamber with a fluid,
- electrohydraulic discharge into the fluid contained in the hollow chamber,
- draining of the hollow chamber,
- removal of the formed part.

The steps of filling and draining of the hollow chamber represent the most time-consuming steps.

SUMMARY OF THE INVENTION

The aim of the present invention is notably to provide an effective solution making it possible to form pieces, while reducing the cycle time and guaranteeing an equivalent result.

The invention thus relates to an electrohydraulic forming chamber for forming a piece.

The electrohydraulic forming chamber for forming a piece comprises:

- a first part, called discharge frame, comprising an internal wall delimiting a discharge chamber intended to receive a volume of fluid,
- a second part, called die, comprising a forming chamber having an imprint intended to complement the form that the piece has to take after deformation,
- an electrohydraulic discharge system.

The piece is intended to be positioned, in this electrohydraulic forming chamber, between the discharge chamber and the forming chamber before an activation of said electrohydraulic discharge system, the activation of said electrohydraulic discharge system resulting in the projection and the deformation of the piece against the imprint of the forming chamber.

Activation should be understood to mean the creation, via the electrohydraulic discharge system, of an electrical discharge into the fluid in order to create a shockwave which is propagated in the fluid.

The discharge frame is preferably produced in a high-strength material, for example a metallic material such as steel, to contain the high pressures generated upon the activation of the electrohydraulic discharge system.

According to the invention, all or part of the internal wall has a non-metallic coating.

A coating is a layer, which is deposited on the surface of a piece, of a material, in this case the internal wall, to give it particular properties. The constituent material of the coating covers the internal wall, partially or totally, but in such a way that said constituent material of the coating is ultimately integral to this space.

The non-metallic coating is preferentially arranged on the internal wall, around and in proximity to the ports of the electrohydraulic discharge system in the discharge chamber.

Such a non-metallic coating advantageously makes it possible to avoid the formation of an electrical arc between the electrohydraulic discharge system and the internal wall. Such an electrical arc could damage the internal wall, and above all would greatly reduce the efficiency of the electrohydraulic discharge system, not allowing the steel plate to be formed.

Thus, the dimensions of the discharge chamber can be reduced without fear of such an electrical arc. The reduced dimensions of the discharge chamber then advantageously make it possible to reduce the volume of fluid needed to fill said discharge chamber. Consequently, the cycle time needed to perform a forming method using such an electrohydraulic forming chamber is very greatly reduced and the rate of production is greatly increased.

Such an electrohydraulic forming chamber is particularly suited to the production of pieces of small dimensions, such as, for example, a USB (universal serial bus) key body, created for example with fine etchings.

According to preferred embodiments, the invention also meets the following features, implemented separately or in each of their technically operative combinations.

According to preferred embodiments, to further mitigate the risk of electrical arc, the coating is a coating produced in an electrically insulating material.

According to preferred embodiments, the internal wall is covered by a plurality of non-metallic coatings.

According to preferred embodiments, the electrohydraulic discharge system comprises two electrodes intended to be linked to an electrical energy storage unit.

According to preferred embodiments, the electrohydraulic discharge system comprises an explosive wire intended to be linked to an electrical energy storage unit.

According to preferred embodiments, the electrohydraulic discharge system comprises an explosive wire linked between two electrodes.

The invention also relates to an electrohydraulic forming machine comprising an electrohydraulic forming chamber according to one of its embodiments and an electrical energy storage unit linked to the electrohydraulic discharge system.

DESCRIPTION OF THE FIGURES

The features and advantages of the invention will become more clearly apparent in light of the examples of implementation hereinbelow, provided simply for illustrative purposes and in no way limiting to the invention, with the support of FIGS. 1 to 3, in which.

DETAILED DESCRIPTION OF AN EMBODIMENT OF THE INVENTION

Figure 1:
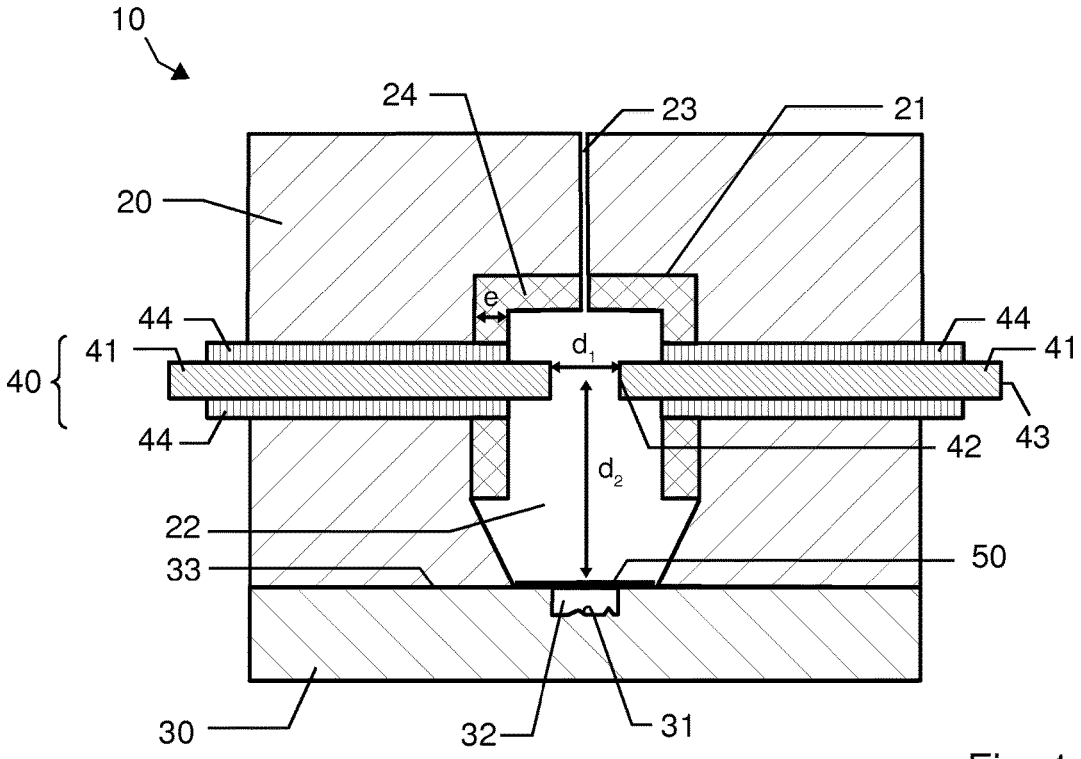
FIG. 1 represents a cross-sectional view of an electrohydraulic forming chamber according to an embodiment of the invention.

An electrohydraulic forming chamber 10 for forming a piece 50 according to an embodiment of the invention is illustrated in FIG. 1. The pieces to be formed can be of flat form, or, as a variant, of tubular form. The pieces can also be preformed by conventional stamping techniques.

This electrohydraulic forming chamber is used in the context of a conventional forming method which will be recalled later.

The electrohydraulic forming chamber 10 is produced in two parts. The electrohydraulic forming chamber 10 comprises a first part, called discharge frame 20, and a second part, called die 30. The discharge frame 20 can represent an upper part of the electrohydraulic forming chamber (according to the orientation of the figures) and the die 30 can represent a lower part, as illustrated in the figure. As a variant, and without departing from the scope of the invention, it is possible to envisage the discharge frame 20 representing a lower part of the electrohydraulic forming chamber (according to the orientation of the figures) and the die 30 representing an upper part. Also as a variant, the first part can represent a left part of the electrohydraulic forming chamber (according to the orientation of the figures) and the second part can represent a right part of the electrohydraulic forming chamber (according to the orientation of the figures) or vice versa.

The discharge frame 20 comprises an internal wall 21 delimiting a discharge chamber 22.

For its part, the die 30 comprises a forming chamber 32 intended to be opposite the discharge chamber 22 when the discharge frame 20 and the die 30 are assembled.

The discharge frame 20 and the die 30 are removable from one another so as to allow the insertion and the removal of the piece 50 to be formed.

Said piece to be formed is arranged, at an interface 33 between the die 30 and the discharge frame 20, and held in position hermetically. Once in position in the electrohydraulic forming chamber, the piece to be formed separates the forming chamber 32 from the discharge chamber 22.

Figure 2:
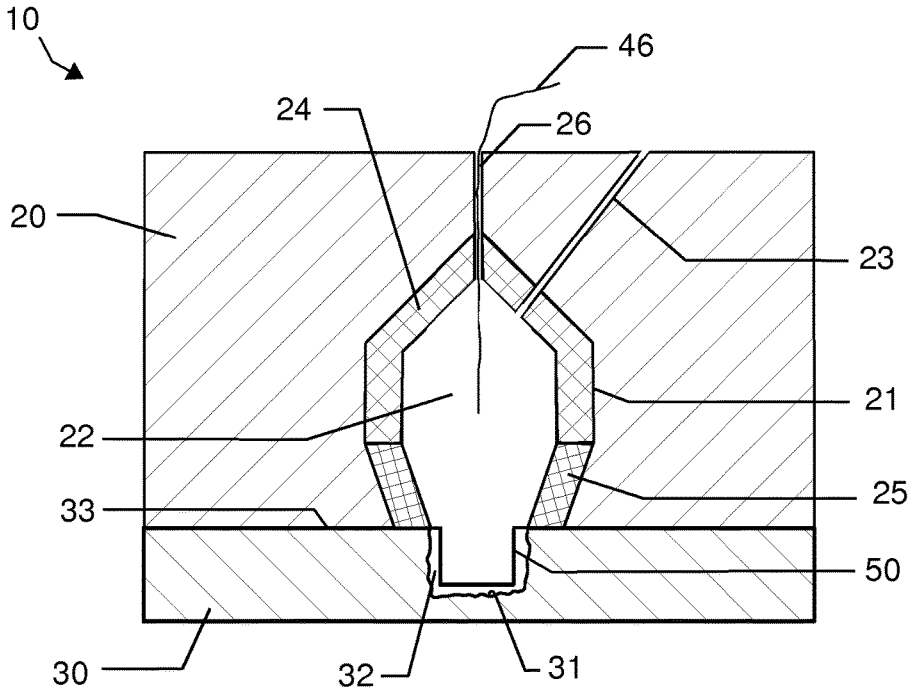
FIG. 2 illustrates a cross-sectional view of an electrohydraulic forming chamber according to another embodiment of the invention.

In the example of FIG. 1, the piece to be formed is a piece of flat form. In the example of FIG. 2, the piece to be formed is a piece of tubular form.

The forming chamber 32 has, facing the piece to be deformed, an imprint 31 corresponding to the form that the piece to be formed has to take after deformation.

The discharge frame 20 and the die 30 are preferentially produced in a metal material, for example in steel, in order to exhibit a structural strength of the respective chambers (discharge chamber 22 and forming chamber 32) and contain the high pressures generated at the moment of an electrohydraulic discharge, during the forming process. In effect, the voltage upon an electrohydraulic discharge can reach several tens of kilovolts.

The discharge chamber 22 is intended to be filled with an incompressible fluid, preferably a liquid, for example water.

A water supply duct 23 is produced in the discharge frame 20 to make it possible to link the discharge chamber 22 to a tank (not represented) containing water and to supply said discharge chamber 20 with water.

A water discharge duct (not represented) is produced in the discharge frame 20 to make it possible to link the discharge chamber 22 to a tank and to drain the water from said discharge chamber, into the tank.

In a variant embodiment, the water supply duct 23 and the water discharge duct are simply one and the same duct making it possible to supply and drain the water to/from the discharge chamber from/to a single tank.

The forming chamber 32, for its part, is preferably in air vacuum.

A duct (not represented) is produced in the die 30 to make it possible to link the forming chamber 32 to a vacuum pump (not represented). However, as a variant or in the absence of means for producing this vacuum, it will also be possible to leave the forming chamber 32 at atmosphere and provide vents making it possible to discharge the air during the forming process.

In a preferred embodiment, the electrohydraulic forming chamber 10 and the discharge chamber 22 have a substantially cylindrical geometrical form.

However, without departing from the scope of the invention, the electrohydraulic forming chamber 10 and the discharge chamber 22 can have any geometrical form. More particularly, the discharge chamber 22 can preferentially have a geometrical form such that the internal wall 22 reflects the shockwave, obtained upon the electrohydraulic discharge, toward the piece to be formed 50. For example, an upper part of the internal wall can have a conical form, as illustrated in FIG. 2.

The electrohydraulic forming chamber 10 further comprises an electrohydraulic discharge system 40.

In the nonlimiting example illustrated in FIG. 1, the electrohydraulic discharge system 40 comprises two distinct electrodes 41.

Each electrode 41 passes through the discharge frame 20. A first end 42 of each electrode is positioned inside the discharge frame 20, in the discharge chamber 22. A second end 43, placed outside the discharge frame 20, is linked, via a power supply cable, to an electrical energy storage unit (not represented).

Each electrode 41 is preferentially covered with a jacket 44 of electrically insulating material in order to insulate them electrically from the metal material forming the discharge frame 20.

The electrodes 41 are arranged in the electrohydraulic forming chamber 10 so as to create an inter-electrode distance $d_1$, between the first ends 42 of the two electrodes 41. As is known, this inter-electrode distance $d_1$ makes it possible to define the power of the shockwave generated upon the electrohydraulic discharge, in terms of amplitude and of duration.

Depending on the complexity of the form to be obtained for the piece to be formed and/or the constituent material of the piece to be formed, the inter-electrode distance $d_1$ is increased or reduced, which modulates the energy reached upon the electrohydraulic discharge and influences the power of the shockwave.

In one embodiment, the inter-electrode distance $d_1$ can be adjusted by conventional setting means (not represented), such as, for example, a nut system, provided that the setting operations do not damage the electrodes 41.

The electrodes are also arranged, relative to the piece, so as to maintain a distance $d_2$ between the place of the electrohydraulic discharge and the piece. This distance $d_2$ contributes to the forming of the piece by direct wave.

The electrical energy storage unit, to which the two electrodes 41 are linked, comprises, among other things, at least one capacitor. The various components of the electrical energy storage unit are known to those skilled in the art in their form and in their operation and are not described in more detail in the present description.

The electrohydraulic forming chamber and electrical energy storage unit assembly forms an electrohydraulic forming machine.

Part of the internal wall 21 of the discharge frame 20 has a non-metallic coating 24.

The coating 24 is a layer deposited against all or part of the internal wall 21. The coating 24 partly covers the internal wall 21 and is made integral to it by appropriate means.

Preferably, the coating 24 is chosen so as to exhibit a thickness e that is sufficient to eliminate the risk of electrical arc between the first end 42 of an electrode 41 and the metal discharge frame 20.

In a preferred embodiment, to reduce its thickness e, the non-metallic coating 24 is produced in an electrically insulating material.

Preferably, the coating 24 is chosen to be in a material with very high dielectric strength, greater than 20 kV/mm.

In an exemplary embodiment, when the voltage reached upon the electrohydraulic discharge is 100 kV, and the material chosen for the coating 24 has a dielectric strength of 20 $kV \cdot mm^{-1}$, then the coating will have a thickness of 5 mm.

The coating is also subjected to stresses linked to the impact of the shockwave against the internal wall. The coating has a tensile strength, preferably greater than 20 MPa.

In preferred exemplary embodiments, the material of the coating is a plastic, for example:

high density polyethylene (PEND);
a polytetrafluoroethylene (PTFE);
a polyamide, such as polyamide 6 (PA6);
a polycarbonate (PC);
a polyvinyl chloride (PVC);
a polyether ether ketone (PEEK);
a polyurethane (PU).

In other exemplary embodiments, the material of the coating is a ceramic, such as porcelain for example.

The coating can also be made up of a combination of these materials.

Each electrode 41 passes through the discharge frame 20 at the level of the non-metallic coating 24 of the internal wall 21.

Although an electrical arc can be propagated by creep along the jacket 44 of an electrode 41 and be propagated toward the metal discharge chamber 22, the risk of electrical arc at the join of the insulations (jacket 44 of the electrode 41 and insulating coating 24 of the internal wall 21) is greatly attenuated upon the electrohydraulic discharge between the electrodes 41. In effect, the pressure wave compresses the electrode-jacket assembly in the direction of the electrode 41. In response, the electrode-jacket assembly is radially deformed by expansion at the level of the insulating coating 24. This deformation increases the contact pressure between the insulations, and blocks the passage for a potential electrical arc.

In variant embodiments, the internal wall is all covered with a single non-metallic coating or with a plurality of non-metallic coatings.

For example, the internal wall 21 illustrated in FIG. 2 is covered with two non-metallic coatings 24, 25. The non-metallic coating 24, situated at the level of the two electrodes, is chosen to be in a material with greater dielectric strength than the second coating 25, in order to reinforce the structural and insulating nature of the discharge frame 20, in proximity to the electrohydraulic discharge.

Such an electrohydraulic forming chamber 10, through the non-metallic coating 24 of all or part of the internal wall 21, advantageously makes it possible to produce a discharge chamber 22 of small volume, for example preferentially less than 1 liter, even more preferentially less than 0.5 liter. This small volume allows for a rapid filling of the discharge chamber, of the order of 5 seconds.

It is thus possible to envisage producing several electrohydraulic discharges per minute, for example at least two electrohydraulic discharges per minute, preferably six electrohydraulic discharges per minute.

Figure 3:
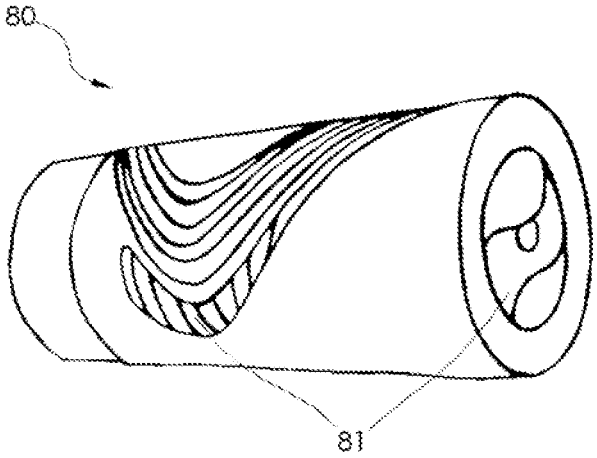
FIG. 3 illustrates a USB key body etched by means of an electrohydraulic forming chamber according to one of the embodiments of the invention.

Such an electrohydraulic forming chamber 10 is particularly suited to the production of parts of small dimensions, such as, for example, a USB key body 80 decorated for example with fine etchings 81, as illustrated in FIG. 3.

The invention is not limited to the preferred embodiments described above as nonlimiting examples and to the variants described. It relates also to the variant embodiments within the scope of those skilled in the art.

In particular, as illustrated in FIG. 2, the electrohydraulic discharge system 40 can have, as variant to the two electrodes, an explosive wire 46. The explosive wire is known to those skilled in the art in its operation and will not be described in more detail in the present description.

In this variant, a passage duct 26 is produced in the discharge frame 20, passing through it at the level of the non-metallic coating 24 of the internal wall 21, to allow the explosive wire 46 to be run in the discharge chamber 22.

The explosive wire 46 is preferentially positioned at the center of the discharge chamber, opposite the non-metallic coating of the internal wall.

The thickness of the coating 24 is also a function of the energy generated upon the electrohydraulic discharge.

In another variant embodiment, the electrohydraulic discharge system 40 can comprise an explosive wire between two electrodes.

In this variant, a passage duct is produced in an electrode, to allow the explosive wire to be run between the two electrodes in the discharge chamber.

An example of an electrohydraulic forming method based on the electrohydraulic forming chamber 10 is now described.

To form a piece 50 by electrohydraulic forming, the method comprises a first step of positioning of the piece to be formed in the electrohydraulic forming chamber 10.

The piece 50, for example initially flat, is positioned between the discharge frame 20 and the die 30. The piece 50 is arranged in the electrohydraulic forming chamber 10 so as to be facing the imprint 31, and to separate the discharge chamber 22 from the forming chamber 32.

The piece is held in position and in the electrohydraulic forming chamber, so as to make the forming chamber hermetically watertight relative to the discharge chamber.

The method then comprises a step of filling of the discharge chamber with water.

Water is introduced into the discharge chamber via the water supply duct 23, until it is filled.

The method next comprises a step of electrohydraulic discharge in the fluid contained in the discharge chamber.

One means for carrying out this step consists in rapidly discharging the at least one capacitor of the electrical energy storage unit.

The electrohydraulic discharge system is activated.

In the electrodes variant, an electrical arc is created between the electrodes, creating a bubble in the water.

In the explosive wire variant, the wire introduced into the discharge chamber explodes by vaporization, creating a bubble in the water.

This bubble collapses and releases its energy in the form of a shockwave, which is propagated in the water and projects the piece against the imprint of the forming chamber at very high speed (several hundreds of m/s), resulting in the deformation and the forming thereof. The voltage reached upon the discharge is of the order of several tens of kV.

In the case of pieces of tubular form, the pieces are deformed by radial expansion, instead of being deformed by stamping.

At the end of this step, the piece is formed.

The method then comprises a step of draining of the discharge chamber.

The water is pumped from the discharge chamber to the tank, via the water discharge duct.

The electrohydraulic forming chamber 10 is then opened at the interface 33, freeing access to the forming chamber from which the formed piece is extracted. The above description clearly illustrates that, through its various features and their advantages, the present invention achieves the objectives that were set for it. In particular, it offers an electrohydraulic forming chamber suited to the forming of pieces of small dimensions. It advantageously has an internal wall having a non-metallic coating such that the dimensions of the discharge chamber can be significantly reduced, allowing for a reduction of the volume of liquid needed for the forming method. The cycle time is greatly reduced.

The invention claimed is:

1. An electrohydraulic forming chamber to form a piece, comprising:

a discharge frame comprising an internal wall delimiting a discharge chamber configured to receive a volume of fluid;

a die comprising a forming chamber having an imprint configured to complement a form that the piece will take after deformation;

an electrohydraulic discharge system;

the piece is positioned between the discharge chamber and the forming chamber before an activation of the electrohydraulic discharge system, the activation of the electrohydraulic discharge system resulting in a projection and the deformation of the piece against the imprint of the forming chamber; and wherein the internal wall is covered by two non-metallic coatings, one non-metallic coating situated at a level of the electrohydraulic discharge system having a greater dielectric strength than other non-metallic coating.

2. The electrohydraulic forming chamber as claimed in claim 1, wherein the non-metallic coating is a coating produced in an electrically insulating material.

3. The electrohydraulic forming chamber as claimed in claim 1, wherein the electrohydraulic discharge system comprises two electrodes linked to an electrical energy storage unit.

4. The electrohydraulic forming chamber as claimed in claim 1, wherein the electrohydraulic discharge system comprises an explosive wire linked to an electrical energy storage unit.

5. An electrohydraulic forming machine comprising the electrohydraulic forming chamber as claimed in claim 1 and an electrical energy storage unit linked to the electrohydraulic discharge system.

* * * * *